United States Patent [19]

Drake et al.

[11] Patent Number: 4,985,710

[45] Date of Patent: Jan. 15, 1991

[54] BUTTABLE SUBUNITS FOR PAGEWIDTH "ROOFSHOOTER" PRINTHEADS

[75] Inventors: Donald J. Drake, Rochester; William G. Hawkins, Webster, both of N.Y.

[73] Assignee: Xerox Corporation, New York, N.Y.

[21] Appl. No.: 442,641

[22] Filed: Nov. 29, 1989

[51] Int. Cl.[5] ..... B41J 2/05

[52] U.S. Cl. ..... 346/1.1; 156/633; 156/662; 156/250

[58] Field of Search ..... 346/140, 1.1; 156/633, 156/644, 662, 250

[56] References Cited

U.S. PATENT DOCUMENTS

| | | | |
|---|---|---|---|
| 4,357,614 | 11/1982 | Tamai . | |
| 4,414,553 | 11/1983 | Perna . | |
| 4,601,777 | 7/1986 | Hawkins et al. . | |
| 4,651,164 | 3/1987 | Abe et al. . | |
| 4,680,595 | 7/1987 | Cruz-Uribe et al. . | |
| 4,786,357 | 11/1988 | Campanelli | 156/633 |
| 4,789,425 | 12/1988 | Drake et al. . | |
| 4,829,324 | 5/1989 | Drake | 346/140 |
| 4,878,992 | 11/1989 | Campanelli | 156/633 |

*Primary Examiner*—Joseph W. Hartary
*Attorney, Agent, or Firm*—Oliff & Berridge

[57] ABSTRACT

A "roofshooter" pagewidth printhead for use in a thermal ink jet printing device is fabricated by forming a plurality of subunits, each being produced by bonding a heater substrate having an architecture including an array of heater elements and an etched ink feed slot to a secondary substrate having a series of spaced feed hole openings to form a combined substrate in which said series of spaced feed hole openings communicates with said ink feed slot, and dicing said combined substrates through said ink feed slot to form a subunit. An array of butted subunits having a length equal to one pagewidth is formed by butting one of said subunits against an adjacent subunit. The array of butted subunits is bonded to a pagewidth support substrate. The secondary substrate provides an integral support structure for maintaining the alignment of the heater plate which, if diced through the feed hole without the secondary substrate, would separate into individual pieces, thereby complicating the alignment and assembly process.

20 Claims, 11 Drawing Sheets

BUTTABLE SUBUNITS FOR PAGEWIDTH "ROOFSHOOTER" PRINTHEADS

BACKGROUND OF THE INVENTION

1. Field of the Invention

The present invention relates to methods of fabricating thermal ink jet printheads, and particularly to methods of fabricating pagewidth "roofshooter" printheads from an array of silicon wafer subunits (or chips).

2. Description of the Related Art

Generally speaking, drop-on-demand ink jet printing systems can be divided into two types; one type using a piezoelectric transducer to produce a pressure pulse that expels a droplet from a nozzle; or another type using thermal energy to produce a vapor bubble in an ink filled channel that expels a drop.

Thermal ink jet printing systems use thermal energy selectively produced by resistors located in capillary filled ink channels near channel terminating nozzles or orifices to vaporize momentarily the ink and form bubbles on demand. Each temporary bubble expels an ink droplet and propels it towards a recording medium. The printing system may be incorporated in either a carriage type printer or a pagewidth type printer. The carriage type printer generally has a relatively small printhead, containing the ink channels and nozzles. The printhead is usually sealingly attached to a disposable ink supply cartridge and the combined printhead and cartridge assembly is reciprocated to print one swath of information at a time on a stationarily held recording medium, such as paper. After the swath is printed, the paper is stepped a distance equal to the height of the printed swath, so that the next printed swath will be contiguous therewith. The procedure is repeated until the entire page is printed. For an example of a cartridge type printer, refer to U.S. Pat. No. 4,571,599 to Rezanka. In contrast, the page width printer has a stationary printhead having a length equal to or greater than the width of the paper. The paper is continually moved past the pagewidth printhead in a direction normal to the printhead length and at a constant speed during the printing process. Refer to U.S. Pat. No. 4,463,359 to Ayata et al for an example of pagewidth printing and especially FIGS. 17 and 20 therein.

U.S. Pat. No. 4,463,359 mentioned above discloses a printhead having one or more ink filled channels which are replenished by capillary action. A meniscus is formed at each nozzle to prevent ink from weeping therefrom. A resistor or heater is located in each channel upstream from the nozzles. Current pulses representative of data signals are applied to the resistors to momentarily vaporize the ink in contact therewith and form a bubble for each current pulse. Ink droplets are expelled from each nozzle from the growth of the bubbles which causes a quantity of ink to bulge from the nozzle and break off into a droplet at the beginning of the bubble collapse. The current pulses are shaped to prevent the meniscus from breaking up and receding too far into the channels, after each droplet is expelled. Various embodiments of linear arrays of thermal ink jet print devices are shown, such as those having staggered linear arrays attached to the top and bottom of a heat sinking substrate for the purpose of obtaining a pagewidth printhead. Such arrangements may also be used for different colored inks to enable multi-colored printing.

U.S. Pat. No. 4,789,425 to Drake et al (the disclosure of which is herein incorporated by reference) discloses a thermal ink jet printhead of the type which expels droplets on demand towards a recording medium from nozzles located above and generally parallel with the bubble generating heating elements contained therein. The droplets are propelled from nozzles located in the printhead roof along trajectories that are perpendicular to the heating element surfaces. Such configurations are sometimes referred to as "roofshooter" printheads.

For example, as illustrated in the isomeric view of the printhead 10 in FIG. 1 hereto, arrows 11 depict the trajectory of ink droplet 13 emitted from nozzles 12. The printhead 10 includes a structural member 14 permanently attached to a heater plate or substrate 28 containing an etched opening or feed slot 20 (shown in phantom) which when mated to the structural member 14, forms an ink reservoir or manifold. The cross-sectional view of the printhead 10 in FIG. 2 taken along lines II—II of FIG. 1 illustrates the ink flow path from the feed slot 20 in the heater plate 28 through the nozzles 12 in the roof 24. The ink flows into a channelled recess 18 defined by a cavity wall 22 and channel walls 17 between the roof 24 and heater plate 28, and then passes over a heating element 34 with its addressing electrode 33 and common return 35 before exiting through the nozzle 12. The plan view of the printhead (FIG. 3; taken along lines III—III of FIG. 1) illustrates the recess 18 having four channel walls 17 which produce three ink channels communicating between the nozzles 12 (shown in phantom because they are in the roof 24) and the feed slot 20. (It is understood that a true view along the lines III—III would show a heating element and associated ink channel density of 300 per inch (25 mm) or more, the reduced number being shown here for clarity.)

Drop on demand thermal ink jet printheads as discussed above are fabricated by using silicon wafers and processing technology to make multiple small heater plates and channel plates. This works extremely well for small printheads. However, for large arrays or pagewidth printheads, a monolithic array of ink channels or heater elements cannot be practically fabricated in a single wafer since the maximum commercial wafer size is generally six inches. Even if ten inch wafers were commercially available, it is not clear that a monolithic channel array or heater array would be very feasible. This is because one defective channel or heating element out of 2,550 channels or heating elements would render the entire channel or heater plate useless. This yield problem is aggravated by the fact that the larger the silicon ingot diameter, the more difficult it is to make it defect free. Also, relatively few 8½ inch channel plates or heater plate arrays could be fabricated in a 10 inch wafer. Most of the wafer would be thrown away, resulting in very high fabrication costs.

To obviate this problem, it is proposed to create a pagewidth printhead by forming an array of roofshooter subunits butted together to form the pagewidth array. However, in order to produce high quality characters with ink jet printers it is essential to provide a printhead with a high density of precisely aligned nozzles so that each subunit in a pagewidth array must be precisely located relative to an adjacent subunit. As can be seen from FIG. 4A which schematically illustrates only the heater plate 28 of FIG. 3 with the heating element 34, electrode 33 and the feed slot 20, in order to provide a high density arrangement of nozzles on a roofshooter pagewidth printhead, the best location for dicing each heater plate (designated a—a and a'—a') intersects the feed slot 20 causing the heater plate to become two separate pieces 28A, 28B (as illustrated in FIG. 4B) which are difficult to realign with each other, or with the roof 24 to construct the roofshooter printhead. One solution to this problem could be to break up the feed slot into a number of smaller slots $F_1$, $F_2$, $F_3$ as shown in FIG. 5. However, the geometry of anisotropic silicon etching causes the slots to be separated by a minimum of 29 mils at the level of the heater elements 34. This amount of separation is unacceptable because it would be difficult to ensure that ink would flow to the heater elements 34' located between the slots since the fluid feed resistance of the heater elements 34' between slots will likely be substantially greater than that of heater elements 34 adjacent to a slot.

Another difficulty in designing a buttable printhead subunit lies in the fact that it is difficult to make electrical connections to the printhead at the same density as the transducer array. For example, it is possible to make thermal ink jet heater and nozzle arrays at a resolution density of 600 elements per inch. However, typical production wire bond densities are limited to about 100 elements per inch. For small arrays, a limited number of heaters can be directly addressed by fanning out the addressing electrode lines to provide for a lower bonding pad density as shown in FIG. 10. However, this technique consumes more silicon area than is required by the transducer array, and it is not possible to use this design with a large continuous array of buttable printhead subunits.

OBJECTS AND SUMMARY OF THE INVENTION

It is an object of the present invention to provide a method of producing a pagewidth printhead having a high density arrangement of ink jet nozzles thereon.

It is another object of the present invention to provide a method of enabling buttable printhead subunits by decreasing the number of electrical interconnection pads required so that the linear distance in the array direction required by the bonding pads is less than the linear distance required by the total of the transducers in the array.

It is another object of the present invention to provide a method of attaching a heater plate to a channel plate of an ink jet printer in a manner which permits a high density arrangement of nozzles in a printhead.

It is a further object of the present invention to provide a method of fabricating a high density "roofshooter" pagewidth printhead.

The present invention makes use of a secondary substrate which is bonded to a heater plate of a "roofshooter" thermal ink jet printhead. This secondary substrate provides structural integrity to the heater plate, enabling the heater plate to be diced through the feed slot without forming two separate pieces. The secondary substrate contains a number of separate feedholes which permit ink to be supplied from a source to the heater plate fill slot.

BRIEF DESCRIPTION OF THE DRAWINGS

The invention will be described in detail with reference to the following drawings in which like reference numerals refer to like elements and wherein.

DETAILED DESCRIPTION OF THE PREFERRED EMBODIMENTS

Figure 1:
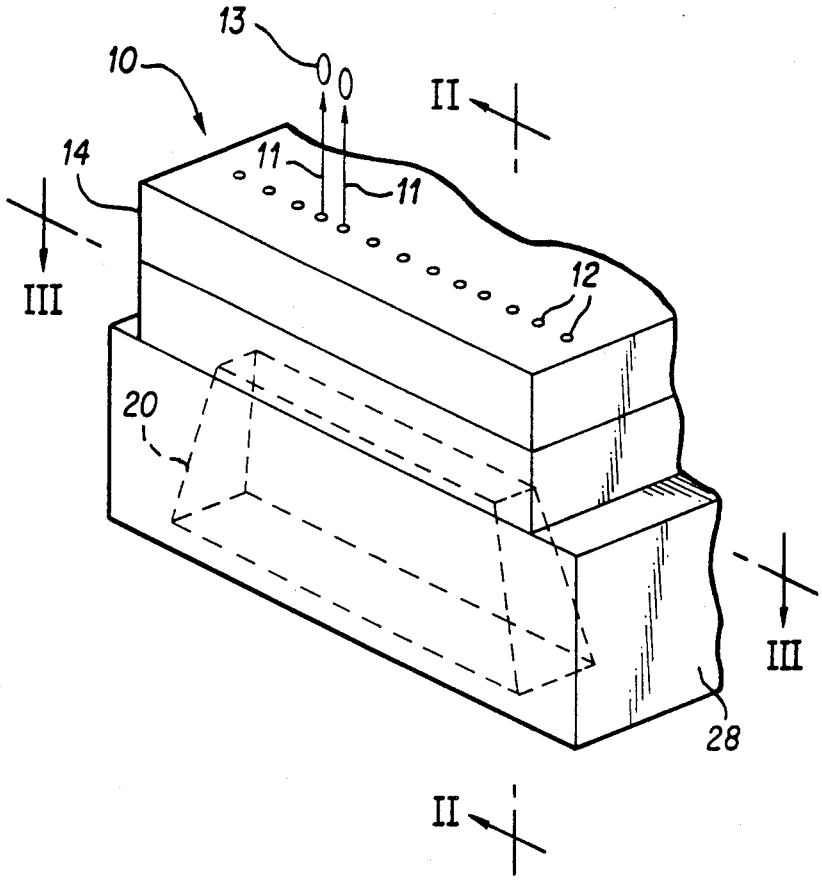
FIG. 1 PRIOR ART
FIG. 1 is an enlarged isometric view of a roofshooter printhead.
Figure 2:
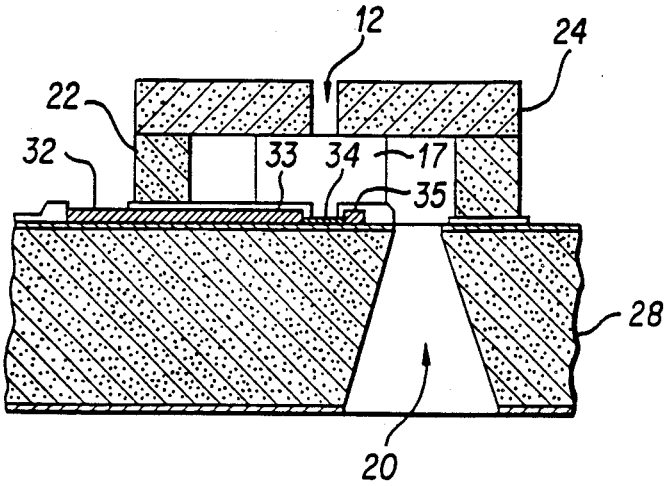
FIG. 2 is an enlarged cross-sectional view of the printhead taken along the lines II—II of FIG. 1.
Figure 3:
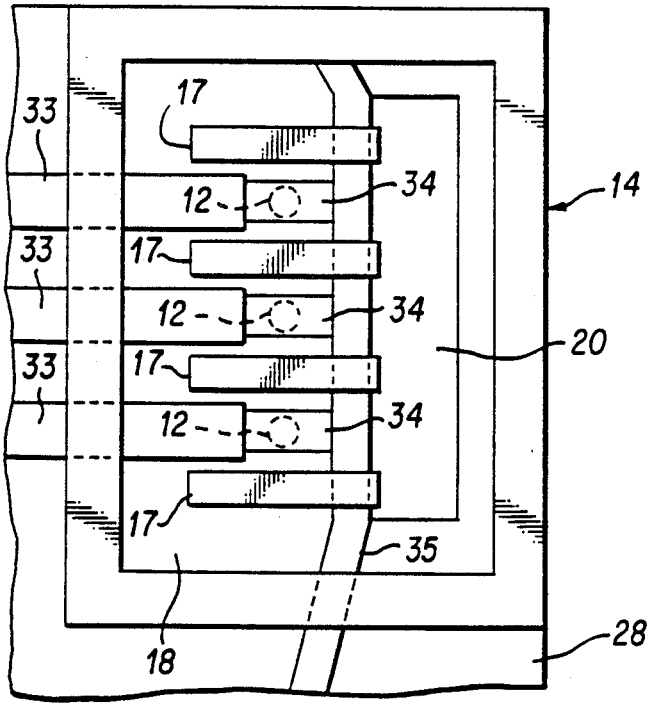
FIG. 3 is a schematic plan view of the printhead taken along the lines III—III of FIG. 1.
Figure 4A:
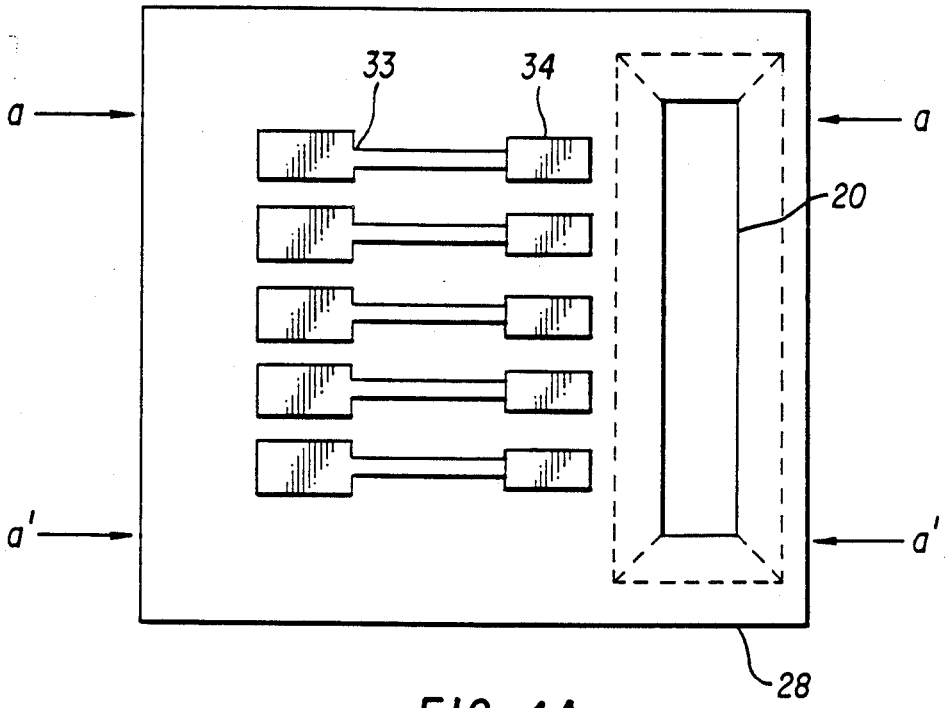
FIG. 4A is a plan view of the heater plate of FIG. 3.

FIG. 4A shows one type of heater plate 28 for a "roofshooter" printhead. The heater plate 28 can be made by a process as disclosed in U.S. Pat. No. 4,789,425 to Drake et al, the disclosure of which is herein incorporated by reference, but the design of the heater elements 33, 34 on the heater plate 28 is slightly modified since the addressing electrodes 33 should be located on the sides of the subunit so as not to interfere with the dicing operation discussed herein. A preferred substrate for constructing the heater plate 28 is a (100) silicon wafer, although other similar substrates can be used. The heater plate 28 includes a feed slot 20 through which ink is fed from a lower surface of the heater plate 28 to the upper surface of the heater plate 28. When the heater plate 28 is a (100) silicon wafer, the preferred process for fabricating the feed slot 20 is anisotropic etching, although other processes such as dicing can be used. Anisotropic etching or dicing permit highly precise placement and dimensioning of the feed slot 20. The upper surface of the heater plate 28 also includes an array of heater elements which include a resistive heater element 34 which is heated upon the application of an electrical impulse which is applied to the addressing electrodes 33. The array of heater elements are aligned in a first direction, and the feed slot 20 is aligned in a second perpendicular direction. The length of the feed slot 20 in the second direction is greater than the extent of the heater element array in the second direction. In order to fabricate a pagewidth printhead made from an array of heater plate subunits, each heater plate subunit should be diced in the first direction through the lines a—a and a'—a' in order to provide a high density uniform arrangement of nozzles. The dicing can be performed by sawing or other suitable methods.

Figure 6:
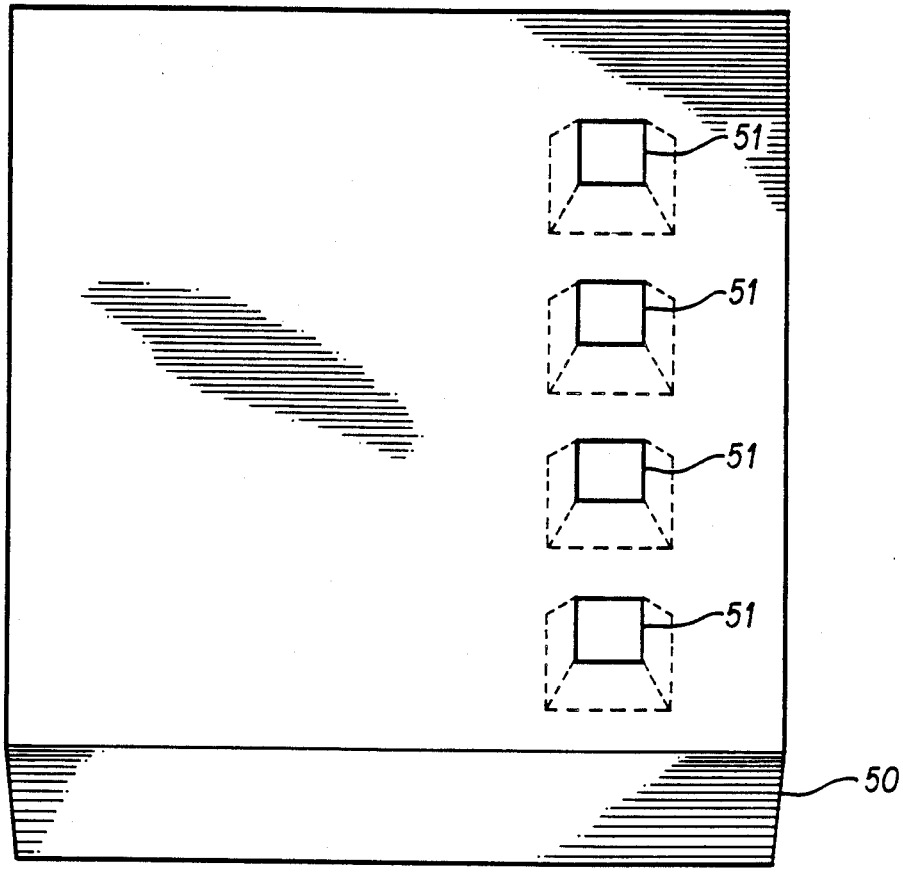
FIG. 6 is a plan view of a secondary plate.

In order to prevent the heater plate from separating into undivided pieces 28A, 28B after dicing, the present invention makes use of a secondary plate 50, shown in FIG. 6, which is attached to the base surface of the heater plate prior to dicing. The secondary plate 50 includes a series of feedhole slots 51 which allow ink to be fed from a source to the heater plate feed slot 20. A preferred material for the secondary substrate is a (100) silicon wafer, although other similar materials can be used as well. When a (100) silicon wafer is used, the feedhole slots 51 are preferably formed by anisotropic etching.

Figure 4B:
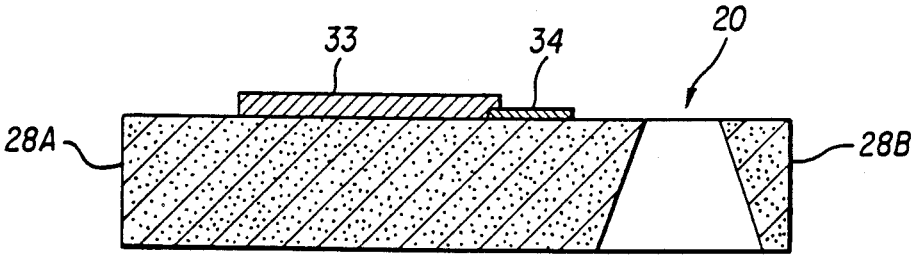
FIG. 4B is a cross-sectional view of the heater plate of FIG. 4A when diced along the lines a—a, a'—a' of FIG. 4A.
Figure 5:
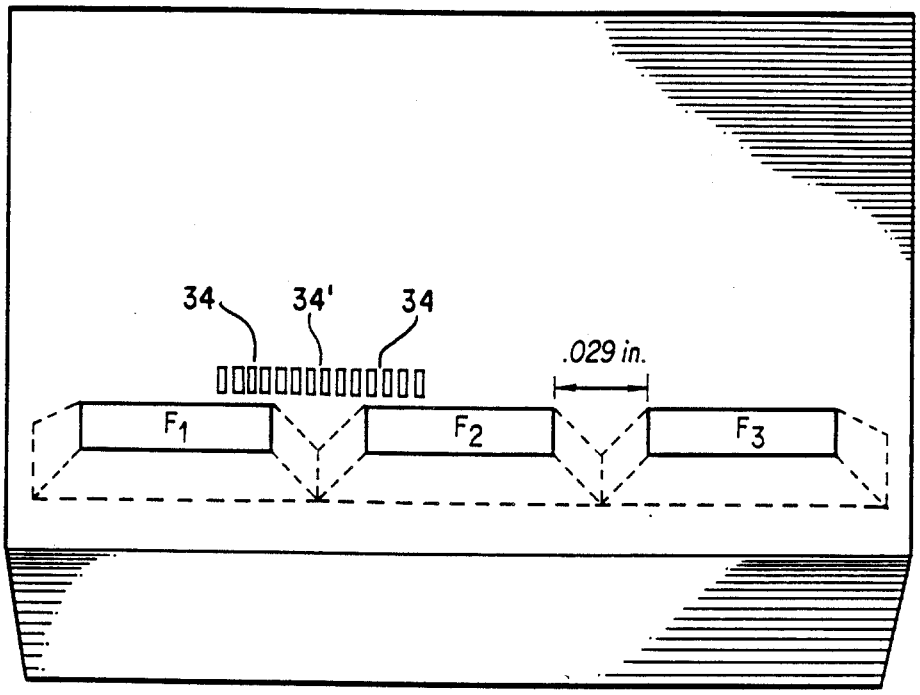
FIG. 5 PRIOR ART
FIG. 5 is a plan view of a modified heater plate.
Figure 7:
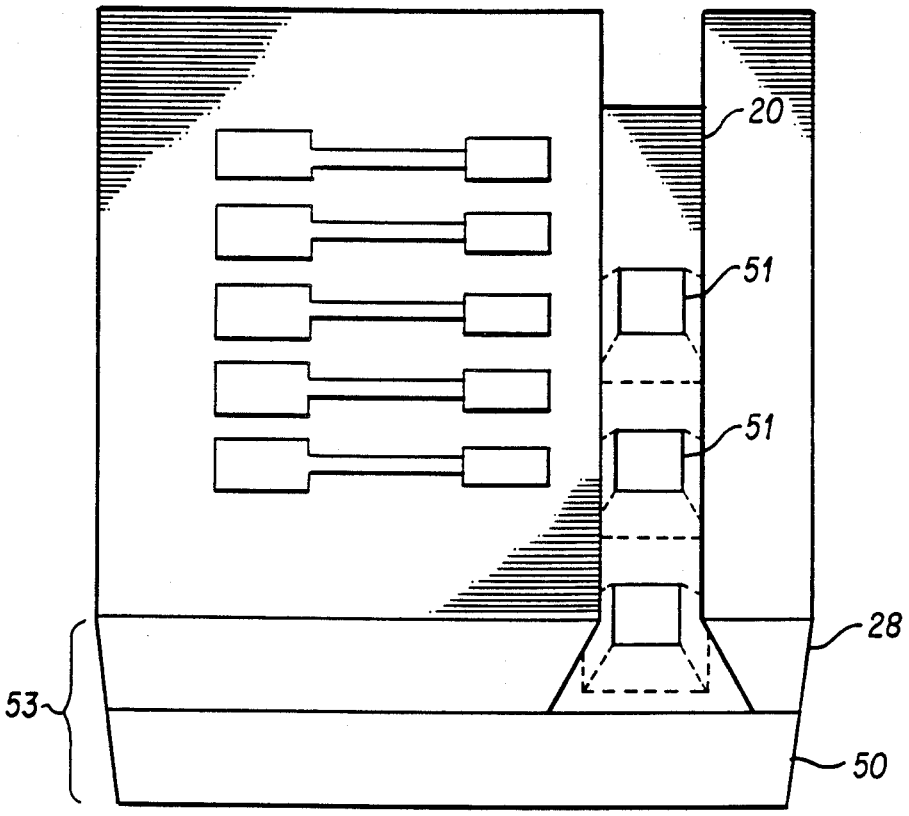
FIG. 7 is a plan view of the combined structure of the secondary plate of FIG. 6 attached to the heater plate of FIG. 4A.

As shown in FIG. 7, when the secondary plate 50 is attached to the base surface of the heater plate 28 prior to dicing, an integral wafer subunit or combined substrate 53 is obtained after dicing through the feed slot 20. That is, the secondary plate 50 is attached to the heater plate 28 with the feedhole slots 51 of the secondary plate communicating with the feed slot 20 of the heater plate 28. The combined substrate 53 of the heater plate 28 and secondary plate 50 is then diced through the feed slot 20 along the lines a—a, a'—a' (FIG. 4A). The secondary plate 50 maintains the alignment of the two pieces 28A, 28B (FIG. 4B) of the heater plate 28 by providing an integral support structure.

Figure 8:
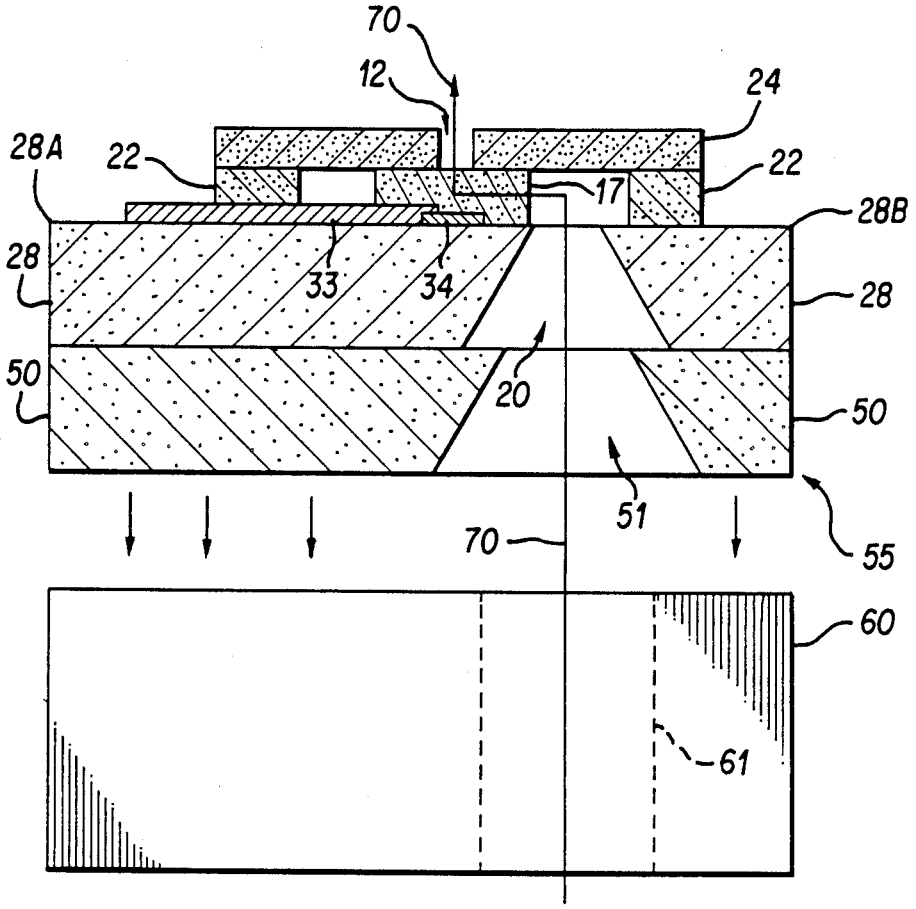
FIG. 8 a cross-sectional view similar to FIG. 2 but showing the combined structure of the secondary plate and heater plate, the combined structure being attached to a pagewidth bar.

As shown in FIG. 8, the fluid handling structure (e.g., cavity wall 22, channel walls 17, roof 24, nozzles 12, etc.) can then be formed on the upper surface of the heater plate 28 to form a "roofshooter" thermal ink jet printhead subunit 55. An array of these subunits 55 can then be attached to a pagewidth bar 60 with their diced sides butting one another to form a pagewidth printhead. The pagewidth bar 60 includes an aperture or slot 61 for supplying ink from an ink source to the feedhole slots 51 in the secondary plate 50 along ink flow path represented by arrow 70.

It is understood that a single printhead subunit can be used as a printhead or an extended array of printhead subunits can be butted to one another to form longer printheads. Extended arrays of subunits are preferred over single long subunits because of the yield problems associated with longer subunits previously discussed. Whether the final printhead is a single subunit or an array of subunits, the open ends of feed slot 20 must be plugged to prevent ink overflow. Cyanoacrylate glue or RTV silicon can be used to seal the open ends of feed slot 20.

The fluid handling structure can be made by any one of the methods disclosed in U.S. Pat. No. 4,789,425 to Drake et al. The fluid handling structure can be formed on the heater plate 28 before or after dicing, although it is preferred to form this structure after dicing since it conserves material. Additionally, the fluid handling structure can be formed on the array of heater plates 28 after they are bonded to the pagewidth bar 60.

Figure 9A:
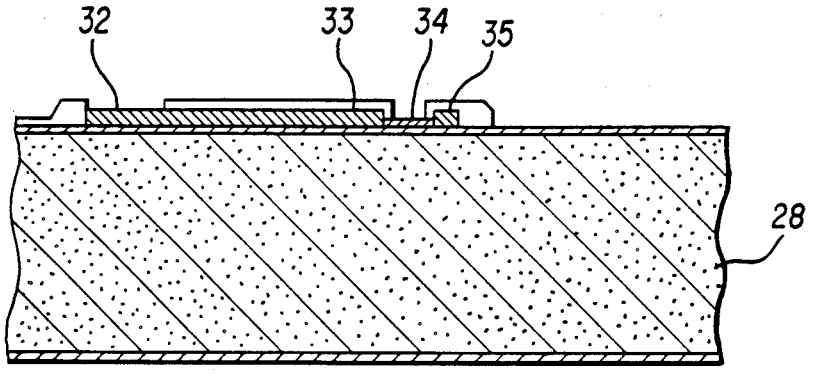
FIGS. 9A–D are cross-sectional views of printheads manufactured according to a second embodiment of the present invention.
Figure 9B:
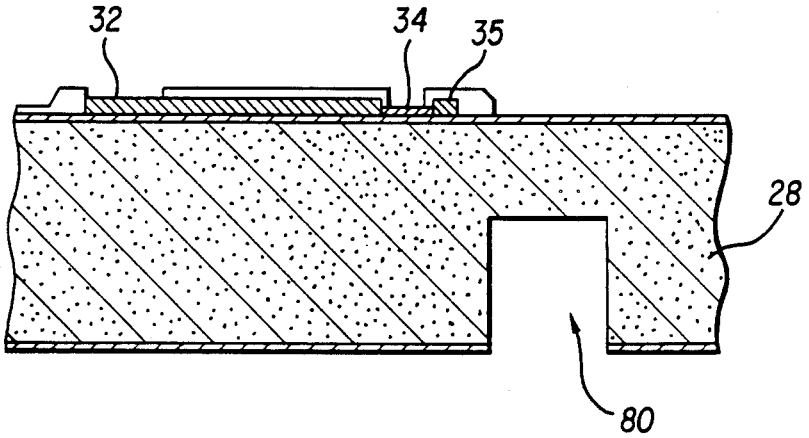
Figure 9C:
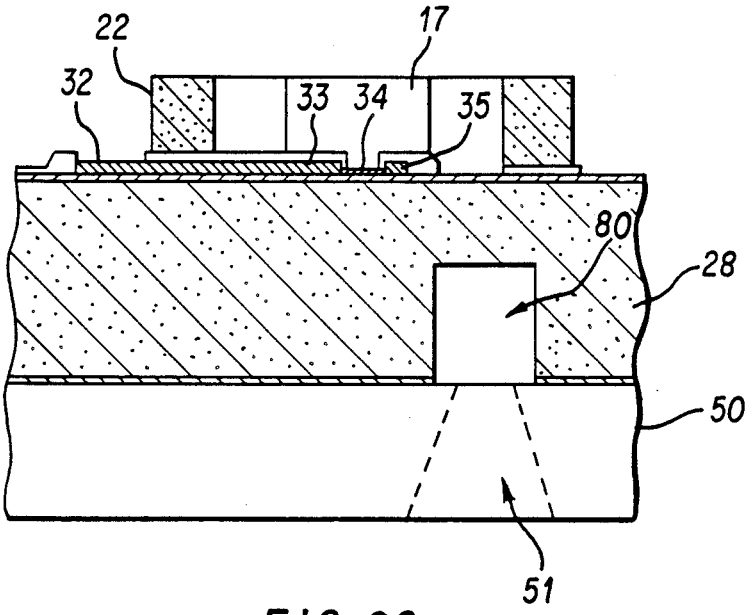
Figure 9D:
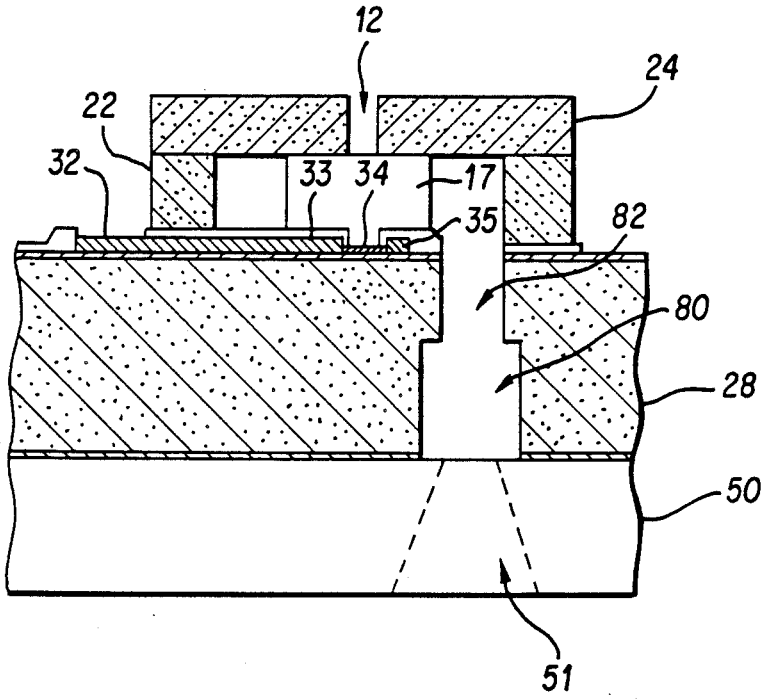

FIGS. 9A–D show cross-sectional views of a roofshooter printhead produced according to a second embodiment of the present invention. FIG. 9A shows a heater 28 having heater elements 34, addressing electrodes 33 and a common return 35 formed on an upper surface thereof. After formation of the circuitry on the upper surface of heater plate 28, a dice cut 80 (see FIG. 9B) is made on the lower surface of heater plate 28. Dice cut 80 extends only partially through the thickness of heater plate 28 and extends through the entire width of heater plate 28 to form an open ended trough. Next, as shown in FIG. 9C, the fluid handling structure 17, 22 is formed on the upper surface of heater plate 28 and the secondary plate 50 having feed holes 51 is bonded to the lower surface of heater plate 28 so that feed holes 51 are aligned with trough 80. As shown in FIG. 9D a second dice cut 82 is made in the upper surface of heater plate 28. Dice cut 82 extends through a thickness of heater plate 28 sufficient to intersect cut 80 and forms, along with cut 80, a feed slot through the entire thickness and width of heater plate 28. Roof 24 having nozzles 12 therein is then formed on the fluid handling structure 17, 22 to complete the printhead. A number of printhead subunits having open ended feed slots 80, 82 can be butted against one another to form a pagewidth array of printheads or only a single printhead subunit can be used. In either case, the open ends of feed slot 80, 82 of the finished printhead are sealed using cyanoacrylate glue or RTV silicon. A benefit of using dice cuts to form the feed slots 80, 82 through the heater plate 28 is that it avoids the use of etchants which can adversely affect the heater plate circuitry.

Figure 10:
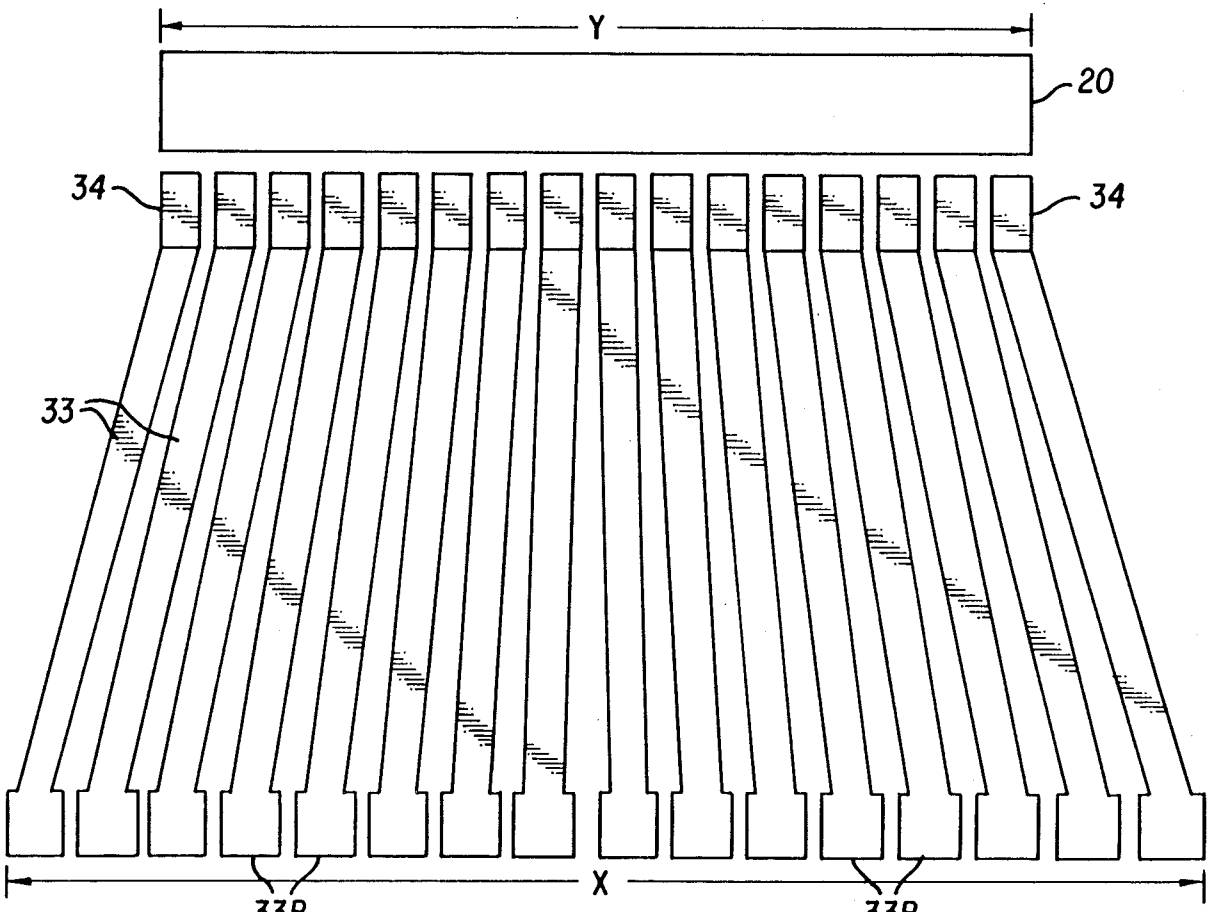
FIG. 10 is a schematic view of a heater plate illustrating the required bonding pad linear distance versus the required transducer, distance.

While the previous description describes a solution to one of the difficulties in fabricating a buttable thermal ink jet subunit printhead, FIG. 10 demonstrates another difficulty. FIG. 10 shows a mismatch in that the permissible linear densities of the transducer array is much higher than the density of the interconnection bonding pad array for directly addressed (passive) arrays. That is, the required bonding pad linear distance X across the bonding pads 33B for the addressing electrodes 33 is greater than the required transducer distance Y across the ink feed slot 20 and array of heating elements 34. Commercial interconnection equipment limits the spacing of interconnection bonding pads 33B to a maximum density of about 100 elements per linear inch, whereas nozzle and heater transducer densities can be 600 elements per linear inch. This mismatch can be compensated for by fanning out the leads to the bonding pads as shown in FIG. 10. However, this solution prevents the transducer arrays from being continuously buttable because the bonding pads extend the lateral chip size beyond the edge transducers.

Figure 11:
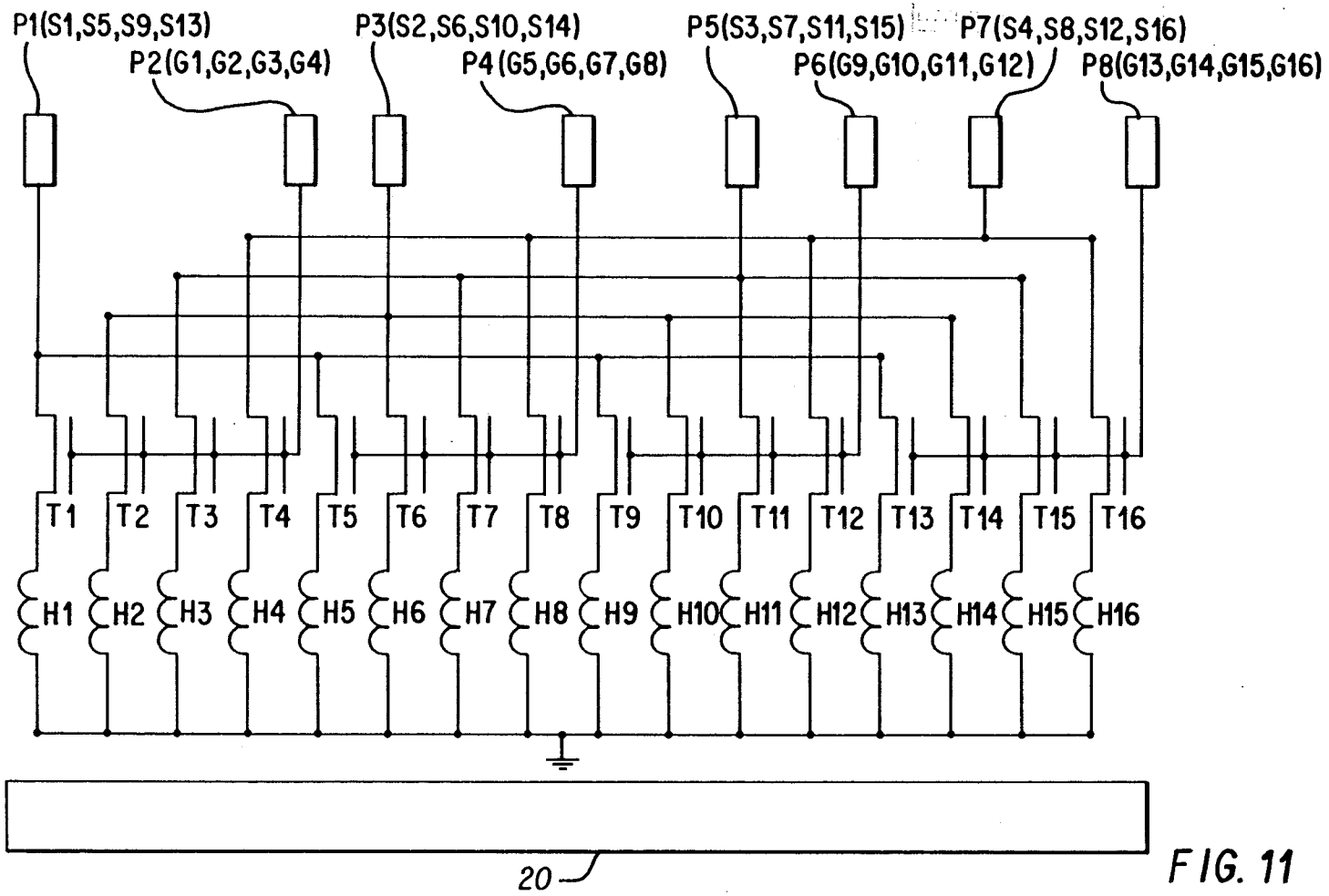
FIG. 11 is a schematic circuit diagram illustrating switching circuitry for reducing the number of bonding pads and thus the required bonding pad linear distance.

A solution to this problem is to incorporate switching circuitry on the transducer chip to decrease the number of address pads required. One type of suitable circuitry, matrix addressing, is described in U.S. Pat. application No. 07/336,624, filed on Apr. 7, 1989 or U.S. Pat. No. 4,651,164, the disclosures of which are herein incorporated by reference. FIG. 11 shows the operation of a matrix address arrays for sixteen heaters H1, H2 . . . H16 each having a drive transistor T1, T2 . . . T16 with a gate G and a source S. One side of the matrix is formed by addressing groups of drive transistor gates, while the other side of the matrix is formed by addressing groups of drive transistor sources. For example, pad P2 switches the gates G1, G2, G3, G4 of the drive transistor gates, and pad P1 switches the sources S1, S5, S9, S13 of the drive transistor sources. It can be seen from FIG. 11 that activating one group of gates and one group of sources uniquely selects one heater transducer. In this particular example, 16 heater transducers are addressed using only 8 address pads. In general, the number of address pads required will be two times the square root of the number of transducers in the array, so that the efficiency of matrix address designs becomes better with larger arrays. It should be noted that there are other forms of switchable addressing circuitry to decrease the ratio of the number of addressing bonding pads to transducer elements and these are intended to be in the scope of this invention.

Although two specific examples are disclosed, the present invention is applicable to any method of printhead fabrication where the preferred dicing line would cause undesirable separation of a subunit. Accordingly, the preferred embodiments of the invention as set forth herein are intended to be illustrative, not limiting. Various changes may be made without departing from the spirit and scope of the invention as defined in the following claims.

What is claimed is:

1. A method for fabricating a printhead subunit for a butted array of printhead subunits for use in a thermal ink jet printing device comprising the steps of:

(a) bonding a heater substrate having an architecture including an array of heating elements and an ink feed slot to a secondary substrate having a series of spaced feed hole openings to form a combined substrate in which said series of spaced feed hole openings communicate with said ink feed slot; and (b) dicing said combined substrate through said ink feed slot to form said subunit.

2. The method of claim 1 wherein the heater substrate architecture includes switchable addressing circuitry to permit a decrease in the ratio of the number of addressing bonding pads relative to the number of heating elements.

3. The method of claim 1 further comprising the steps of:

butting said subunit against an adjacent subunit to form an array of butted subunits; and bonding said array of butted subunits to a support substrate.

4. The method of claim 3 wherein said support substrate is a pagewidth substrate.

5. The method of claim 1 further comprising the step of:

butting said subunit against an adjacent subunit while bonding said butted subunits to a support substrate.

6. The method of claim 5 wherein said support substrate is a pagewidth substrate.

7. The method of claim 1 wherein the architecture of said heater substrate includes an equally spaced, linear array of resistive heating elements each being aligned on said heater substrate in a first direction, and an elongated ink feed slot aligned on said heater substrate in a second direction perpendicular to said first direction, said ink feed slot having a length in said second direction longer than the extent of said array of heating elements in said second direction.

8. The method of claim 7 wherein the step of dicing said combined substrate includes the step of precisely cutting said combined substrate through the ink feed slot in the first direction without intersecting said array of heating elements.

9. The method of claim 1 further comprising the step of forming a fluid handling structure on the subunit to form nozzles and channels communicating with the ink feed hole opening and ink feed slot of the combined substrate.

10. The method of claim 1 wherein the ink feed slot is formed by etching the heater substrate.

11. The method of claim 1 wherein the ink feed slot is formed by dicing the heater substrate.

12. The method for fabricating a printhead for a thermal ink jet printing device comprising the steps of:

(a) bonding a heater substrate having an architecture including an array of heating elements and an ink feed slot to a secondary substrate having a series of spaced feed hole openings to form a combined substrate in which the series of spaced feed hole openings communicate with the ink feed slot; and (b) dicing the combined substrate through the ink feed slot to form the printhead.

13. The method of claim 12 wherein the heater substrate architecture includes switchable addressing circuitry to permit a decrease in the ratio of the number of addressing bonding pads relative to the number of heating elements.

14. A method of fabricating a printhead for use in a thermal ink jet printing device comprising the steps of:

forming a plurality of printhead subunits, each being produced by bonding a heater substrate having an architecture including an array of heater elements and an ink feed slot to a secondary substrate having a series of spaced feed hole openings to form a combined substrate in which said series of spaced feed hole openings communicate with said ink feed slot, and dicing said combined substrate along a dice line through said ink feed slot to form a subunit;

forming an array of butted subunits by butting the dice line of one of said subunits against the dice line of an adjacent subunit; and bonding said array of butted subunits to a support substrate.

15. The method of claim 14 wherein the heater substrate architecture includes switchable addressing circuitry to permit a decrease in the ratio of the number of addressing bonding pads relative to the number of heating elements.

16. The method of claim 14 wherein the steps of forming said array and bonding said array to said support structure are performed simultaneously.

17. The method of claim 14 wherein the support substrate has a pagewidth length to form a pagewidth printhead.

18. The method of claim 14 wherein the architecture of said heater substrate includes an equally spaced, linear array of resistive heating elements each being aligned on said heater substrate in a first direction, and an elongated ink feed slot aligned on said heater substrate in a second direction perpendicular to said first direction, said ink feed slot having a length in said second direction longer than the extent of said array of heating elements in said second direction.

19. The method of claim 18 wherein the step of dicing said combined substrate includes the step of precisely cutting said combined substrate through the ink feed slot in the first direction without intersecting said array of heating elements.

20. The method of claim 14 further comprising the step of forming fluid handling structure on each subunit to form nozzles and channels for supplying ink from the feed hole openings and ink feed slot of the combined substrate to the channels and nozzles of the fluid handling structure.

* * * * *